US005803260A

United States Patent [19]

Tilton

[11] Patent Number: 5,803,260

[45] Date of Patent: Sep. 8, 1998

[54] TOTAL PLASTIC PRODUCT-RETENTION PACKAGE

[75] Inventor: Christopher R. Tilton, Conyers, Ga.

[73] Assignee: Walco Packaging Company, Inc., Conyers, Ga.

[21] Appl. No.: 873,249

[22] Filed: Jun. 11, 1997

[51] Int. Cl.[6] ..... B65D 75/36

[52] U.S. Cl. ..... 206/463; 206/459.5

[58] Field of Search ..... 206/461, 462, 206/463, 470, 497, 459.5

[56] References Cited

U.S. PATENT DOCUMENTS

| | | | |
|---|---|---|---|
| 3,144,343 | 8/1964 | Fritsche | 206/443 |
| 3,173,540 | 3/1965 | Lapides | 206/463 |
| 3,233,725 | 2/1966 | Bixler | 206/463 |
| 3,248,842 | 5/1966 | Peppler . | |
| 3,298,515 | 1/1967 | Watts, Jr. . | |
| 3,776,375 | 12/1973 | Rohdin . | |
| 4,213,531 | 7/1980 | Rae . | |
| 4,249,659 | 2/1981 | Schirmer . | |
| 4,466,534 | 8/1984 | Dunn | 206/6.1 |
| 4,539,793 | 9/1985 | Malek . | |
| 4,969,306 | 11/1990 | Wallin . | |
| 5,539,793 | 7/1996 | Johansson et al. . | |
| 5,579,288 | 11/1996 | Malloy et al. . | |
| 5,595,300 | 1/1997 | Paik et al. | 206/470 |

FOREIGN PATENT DOCUMENTS

| | | |
|---|---|---|
| 1589273 | 10/1976 | United Kingdom . |
| 2029360 | 3/1980 | United Kingdom . |
| 2163130 | 2/1986 | United Kingdom . |

*Primary Examiner*—Jimmy G. Foster

*Attorney, Agent, or Firm*—Watson Cole Grindle Watson, P.L.L.C.

[57] ABSTRACT

A plastic package container having a plastic backing sheet including at least one pair of spaced windows for receiving product; a plastic film covering each one of the windows in the at least one pair of spaced windows and enclosing the product with the plastic backing sheet being folded to align each of the windows of the pair of plastic windows; the flexible plastic films being sealed along a peripheral boundary of the plastic backing sheet with the window and to form a weld band around the peripheral edge of the windows; and a weld band formed around the peripheral edge of the folded plastic backing sheet. In an alternate embodiment of the invention, a plastic package container has first and second separate plastic backing sheets, each including at least one window for receiving product; flexible plastic film covering each of the at least one window and enclosing the product with each window being aligned with the other window; the flexible plastic film being sealed along a peripheral boundary of the respective window; and a weld band formed around the peripheral edge of the folded first and second plastic backing sheets.

10 Claims, 2 Drawing Sheets

Fig. 1.
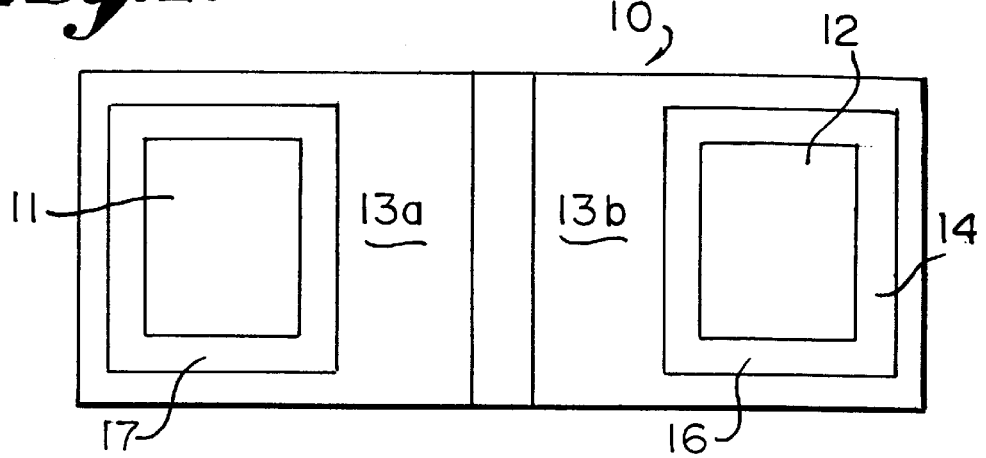
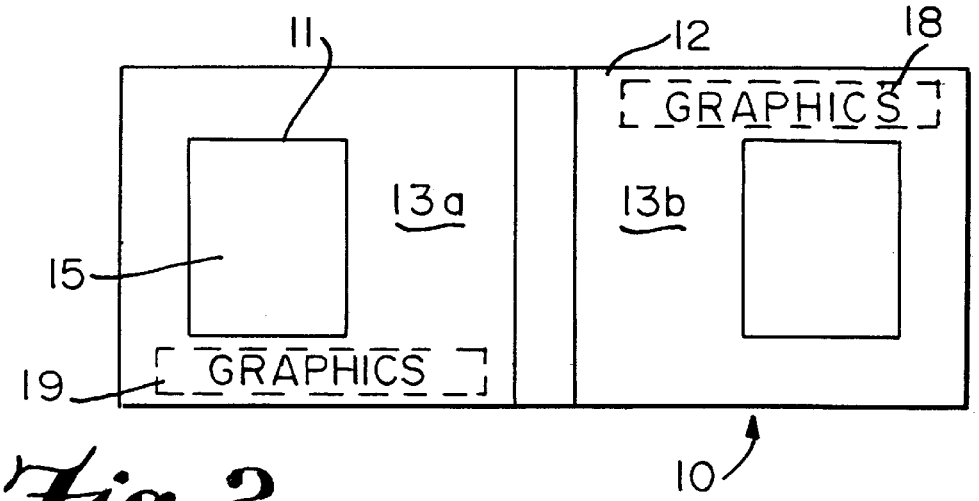
Fig. 2.
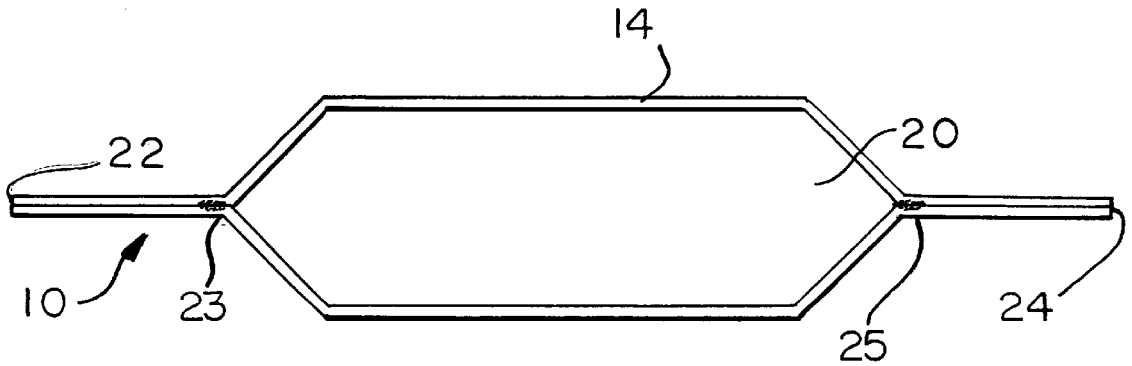
Fig. 3.

TOTAL PLASTIC PRODUCT-RETENTION PACKAGE

BACKGROUND OF THE INVENTION

1. Field of the Invention

This invention relates to product-retaining packages, and more particularly to such product-retaining packages comprising a substantially rigid plastic support with at least one substantially flexible plastic product compartment and with printing on at least one side of the all plastic component package.

2. Related Art

Presently used packages include paperboard in combination with flexible PVC film (stretch pack) and preformed rigid plastic materials sealed to, or in combination with printed paperboard materials (clamshells and blister packs). Clamshell-type packages have a 100% plastic exterior such that the rigid plastic structure is on the outside and printed paperboard is contained inside, which increases the cost of the paperboard component as well as the inherent potential for printed material damage.

Blister and clamshell-type packages cannot be satisfactorily printed using lithographic or flexographic methods because of the irregular non-linear surfaces created by the thermoformed plastic exterior. Additionally, a minimum distance between the edge of the product and the edge of the paperboard must be maintained for structural and sealing purposes. Stretch pack and clamshell-type packages require a wide seal band (common for paperboard) on the inside edge of the card border. Also clamshell-type packages have the same limitation when preformed cavities of rigid plastic are close to the edge of the package requiring a flange area. The flange and seal band areas are cosmetically unappealing and limit the surface area for design and printing graphics. This is a major disadvantage because the extra size of the package consumes valuable retail shelf or hanging space which then restricts potential use of the product-retaining package.

The varying sheet thicknesses of paperboard causes imprecise printing which limits the flexographic or lithographic printing quality. Moreover, paperboard materials have imprecise folding and feeding characteristics on automated sealing equipment, which is a further disadvantage of using paperboard in product-retaining packages.

Also, because of preformed rigid cavity construction, clamshell-type packages are not linear and flat, therefore they do not de-nest and feed efficiently.

Several different combinations of plastic cards and windows are possible. Some finished packages have windows on the front and on the reverse side. Some windows are on one side only and some packages have multiple compartments with one or more sides. However, all combinations use essentially the same type materials and process for their manufacture.

SUMMARY OF THE INVENTION

The present invention provides a product-retaining package wherein plastic materials are printed on one side and have a die cut window with non-rigid film such as PVC or surlyn glued to the non-printed surface area resulting in a flat sheet consisting of flexible film and rigid plastic. This flat sheet comprise of rigid and plastic film is then printed using flexographic or lithographic methods. Using a separate process with industry standard equipment, the flat printed cards are automatically fed and the flexible film is thermoformed to shape a cavity. Subsequently, product is placed into the cavity. Then the one or two piece printed plastic sheet is RF or sonic-sealed together, trapping the product (now in the cavity) between the sealed plastic films. The package is finished after the sealing process has been completed and multiple "up" cards have been slit into single units. At the point of purchase the consumer tears the package open and discards it after removing the product.

It is a primary object of the present invention to provide a printable package of the type specified herein that contains 100% plastic material comprising both a semi-rigid sheet and a flexible plastic film for sealing product therein.

It is a feature of the present invention that the sealed package is made entirely of plastic.

It is an advantage of the present invention that the sealed plastic package is completely transparent except in the area where the product is encapsulated, thereby improving the cosmetic appearance of the sealed package.

It is a further object of the invention to provide a sealed, all plastic package having smaller seals between the plastic components to retain a product, thereby reducing the size of the package.

It is a further feature that the sealed package of the invention provides a small RF band seal which eliminates the need for a wide band seal inside the perimeter of the package.

It is a further advantage of the sealed product-retaining package of the invention that the package size may be reduced because of the reduction in the sealing band.

It is yet a further object of the sealed product-retaining package of the invention that wrinkling, creasing, breaking and separating of the components associated with paperboard materials is eliminated.

It is yet a further feature and advantage of the sealed product-retaining package of the invention that the performance, appearance and durability thereof are greatly increased over known composite paperboard-plastic type product-retaining packages.

It is still a further object of the invention to provide a sealed, all plastic product-retaining package enabling printing on the plastic components of the package.

It is another feature of the sealed all plastic product-retaining package of the invention that there is tighter thickness tolerance of plastic as compared to paperboard materials.

It is another advantage of the sealed, all plastic product-retaining package of the invention that improved print registration is obtainable due to the tighter thickness tolerances of plastic.

It is yet another object of the invention to provide a sealed, all plastic product-retaining package enabling enhanced production techniques.

It is still another advantage and feature of the sealed, all plastic product-retaining package of the invention that manual and automated slitting, folding and feeding characteristics of both the flat preformed card and finished card are improved due to the characteristics of the plastic materials.

Finally, it is a further object of the invention to provide a sealed, all plastic product-retaining package of the invention that provides enhanced recyclable characteristics.

Finally, it is an advantage and feature of the sealed, all plastic product-retaining package of the invention that the package is more easily recyclable due to the lack of paper composite materials in the package.

BRIEF DESCRIPTION OF THE DRAWINGS

The above objects, features and advantages are believed to be readily apparent from the following description of a preferred embodiment of the invention representing the best mode of carrying out the invention, wherein:

FIG. 1 is a view of the reverse side of a two-piece, all plastic product-retaining package in accordance with the invention;

FIG. 2 is a front view of the two-piece, all plastic product-retaining package of FIG. 1;

FIG. 3 is a sectional view of a sealed two-piece, all plastic product-retaining package containing product in accordance with the invention;

DETAILED DESCRIPTION

Figure 4:
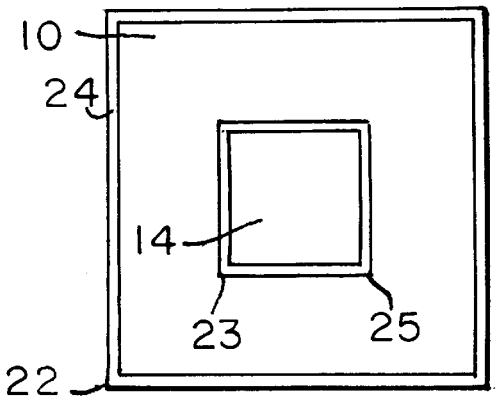
FIG. 4 is a front view of a complete two-piece, all plastic product-retaining package in accordance with the invention and showing a minimum RF seal band width.

FIG. 1 illustrates the reverse side of a two piece all plastic product-retention package 10 in accordance with the invention and having die cut windows 11 and 12 respectively cut in plastic sheet 13*a* and 13*b*. Plastic film overlays 14 and 15 cover the die cut windows 12 and 13, respectively. The flexible plastic film overlays 14 and 15 are retained by glue lines 16 and 17, respectively. Throughout the following description it is understood that the techniques for producing the product-retention package of the invention are made by well known techniques which are applied to plastic materials in a manner known to those skilled in the art of product-retention packages such as stretch pack and clamshell-type product-retention packages using composition materials, i.e. plastic and paperboard.

FIG. 2 illustrates the front side of the two piece all plastic product-retention package 10 of FIG. 1 with die cut windows 11 and 12 and respective plastic film overlays 14 and 15. Printed graphic areas 18 and 19 appear respectively on plastic cards 13*b* and 13*a*. This printing is carried out by well known printing techniques such as flexographic and lithographic printing, but in accordance with the invention the printing is applied to the plastic sheet as opposed to the paperboard as in prior art packages. When plastic pieces 13*a* and 13*b* are folded (in the case of a single plastic backing sheet) or overlapped in aligned relationship (in the case of a two-piece plastic backing sheet) and sealed to one another to trap the product between the plastic overlays 14 and 15, printing graphics are possible on both the front and back of the package.

In the sectional view of an all plastic package in accordance with the invention as illustrated in FIG. 3, which represents the result of folding the plastic card or overlapping two plastic cards as illustrated in FIGS. 1 and 2 so that the product 20 is entrapped between window overlays 14 and 15, forming a PVC film 21 covering the plastic product-retention package 10 and the window overlays 14 and 15 with the entrapped product 20. The entire assembly is RF sealed to form narrow 1/16 inch weld bands 22, 23, 24 and 25 as illustrated in FIG. 3. Weld bands 22 and 24 are formed on the outer portion of plastic product-retention package 10 and weld bands 23 and 25 are formed on the edges of the respective windows as shown in FIG. 3. The narrow weld bands enable graphics to be printed in the areas between bands 22–23 and 24–25, respectively.

Figure 5:
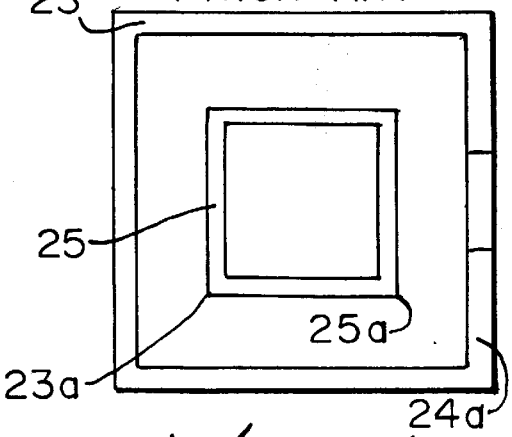
Fig. 5. PRIOR ART
FIG. 5 is a front view of a prior art stretch pack or clamshell-type package showing minimum RF seal and/or flange area.

FIG. 4 illustrates the 1/16 inch RF weld bands 22, 23, 24 and 25 as they appear around window 14 of plastic product-retention package 10. The narrow RF weld bands enable a significant increase in the graphics area that is available in accordance with the present invention over that obtainable with prior art packaging techniques as is apparent from a consideration of FIG. 5, which represents a stretch pack, blister pack or clamshell-type card with a flange. In such prior art products there are 3/8 inch wide band RF seals 22*a*, 23*a*, 23*a* and 24*a*.

Figure 6:
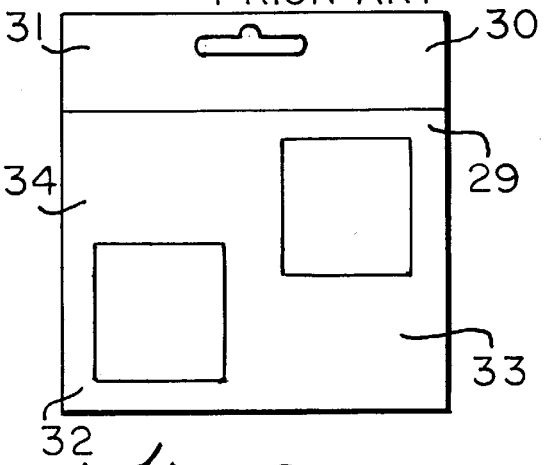
Fig. 6. PRIOR ART
FIG. 6 is a front view of clamshell-type package with an insert card.

FIG. 6 is a front view of a clamshell-type package with an insert card 34 and illustrating a package header 30 which includes a transparent zone 31. Non-transparent areas 32 and 33 of insert paperboard 34 block viewing through the clear plastic. Paperboard 34 is susceptible to damage if the package is subject to bending or impact.

Figure 7:
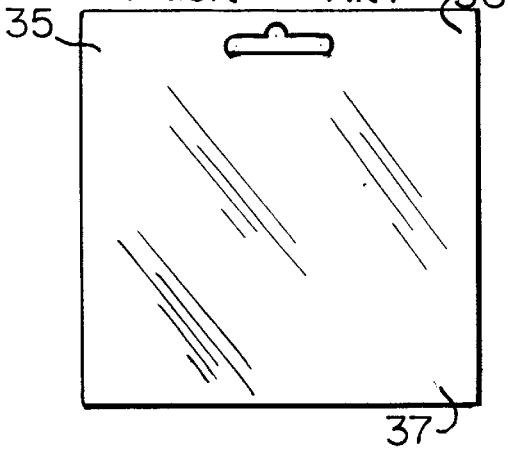
Fig. 7. PRIOR ART
FIG. 7 is a front view of a stretch pack card.
Figure 8:
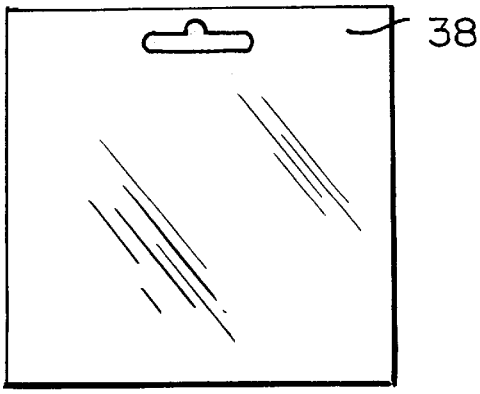
FIG. 8 is a front view of a plastic sheet used in the all plastic product-retention package in accordance with the invention.

FIG. 7 illustrates a stretch pack card 35 including non-transparent areas 36 and 37 which are subject to damage such as tearing and bending during normal handling and shipment. FIG. 8 is a front view of an all plastic card 38 in accordance with the invention and in which the entire area of the card is both fully pliable and fully transparent in the non printed areas.

Figure 9A:
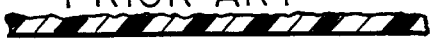
Fig. 9a. PRIOR ART
FIGS. 9*a* and 9*b* are respective side views of a paperboard insert for either a stretch or clamshell-type package.
Figure 9B:
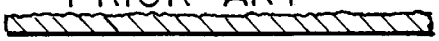
Fig. 9b. PRIOR ART
Figure 10:
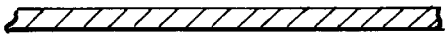
FIG. 10 is a side view of a plastic sheet used in the plastic product-retention package of the invention.

FIGS. 9*a* and 9*b* are respective side views of paperboard illustrating the non-uniformity in paperboard stock used in stretch card and clamshell-type packages and the inconsistent thickness of which inhibits high quality flexographic or lithographic printing. FIG. 10 is a side view of a typical plastic card or film used in the present invention and which has a more consistent thickness, thereby enabling high quality flexographic or lithographic printing.

Table I is a list of common RF sealable plastics which can be used in the previously described all plastic package of the invention.

The above description serves only to describe exemplary embodiments of the best mode of making the invention to demonstrate the features and advantages of its construction and operation. The invention is not intended to be limited thereby, as those skilled in the art of product-retention packages will readily perceive modifications of the above-described embodiments. Thus the invention is intended to be limited only by the following claims and the equivalents to which the claimed components thereof are entitled.

TABLE 1

| RF Sealability of Plastic Materials | |
|---|---|
| ABS | G |
| Acrylics | F |
| Butyrate | G |
| Cellulose acetate | |
| Clear | G |
| Pignented | G |
| Cellulose acetate butyrate | G |

TABLE 1-continued

| RF Sealability of Plastic Materials | |
|---|---|
| Cellulose nitrate | F |
| Cellulose triacetate | F |
| Nylon (polyamide) | G |
| Phenol-formaldehyde | G |
| Pliofilm (rubber hydrochloride) | E |
| PMMA (polymethyl methacrylate) | F |
| Polurethane | G |
| Polyvinyl acetate | G |
| PVC (polyvinyl chloride) | |
| Adhesive emulsions | E |
| Coated paper & cloth | E |
| Flexible, clear | E |
| Flexible, glass-bonded | E |
| Opaque | G |
| Pigmented | E |
| Rigid | F |
| Semi-rigid | G |
| Rubber | E |
| Saran (polyvinylidene chloride) | E |

E = Excellent
G = Good
F = Fair

What is claimed is:

1. A plastic package container, comprising:

a plastic backing sheet including at least one pair of spaced windows for receiving product;

a plastic film covering each one of the windows in said at least one pair of spaced windows and enclosing said product with said plastic backing sheet being folded to align each of the windows of said pair of plastic windows;

said flexible plastic films being sealed along a peripheral boundary of each of said at least one windows and to form a weld band around the peripheral edge of said windows;

a weld band formed around the peripheral edge of the plastic backing sheet, both weld bands having a width no greater than approximately 1/16 inch.

2. A plastic package container according to claim 1, wherein said sealings are RF seals.

3. A plastic package container according to claim 1, wherein said sealings are glue seals.

4. A plastic package container according to claim 1, further comprising printing graphics on selected areas between the weld bands of said plastic sheet.

5. A plastic package container according to claim 4, wherein the selected areas are between the weld bands.

6. A plastic package container, comprising:

first and second separate plastic backing sheets each including at least one window for receiving product;

flexible plastic film covering each of the at least one windows and being sealed by a weld band along a peripheral boundary of the respective window;

product being enclosed between the at least one windows of the first and second plastic sheets with the corresponding at least one windows of the first and second plastic sheets being aligned with one another;

a weld band formed around the peripheral edge of the folded first and second plastic backing sheets, both weld bands having a width no greater than approximately 1/16 inch.

7. A plastic package container according to claim 6, wherein said sealings are RF seals.

8. A plastic package container according to claim 6, wherein said sealings are glue seals.

9. A plastic package container according to claim 6, further comprising printing graphics on selected areas of the weld bands of said first and second plastic sheets.

10. A plastic package container according to claim 9, wherein said selected graphicas areas are between the weld bands.

* * * * *